US012535278B2

(12) United States Patent
Lin

(10) Patent No.: US 12,535,278 B2
(45) Date of Patent: Jan. 27, 2026

(54) HEAT DISSIPATION DEVICE OF HEAT PIPE COMBINED WITH VAPOR CHAMBER

(71) Applicant: TAIWAN MICROLOOPS CORP., New Taipei (TW)

(72) Inventor: Chun-Hung Lin, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 126 days.

(21) Appl. No.: 18/664,290

(22) Filed: May 15, 2024

(65) Prior Publication Data

US 2025/0321058 A1 Oct. 16, 2025

(30) Foreign Application Priority Data

Apr. 16, 2024 (TW) ..... 113114175

(51) Int. Cl.
*F28D 15/04* (2006.01)

(52) U.S. Cl.
CPC ..... *F28D 15/046* (2013.01)

(58) Field of Classification Search
CPC .... F28D 15/04; F28D 15/046; F28D 15/0233; F28F 1/32
See application file for complete search history.

(56) References Cited

U.S. PATENT DOCUMENTS

| | | | | |
|---|---|---|---|---|
| 6,738,257 | B1 * | 5/2004 | Lai | F28F 1/32 174/15.2 |
| 10,612,862 | B2 * | 4/2020 | Mira | F28D 15/0233 |
| 2017/0227298 | A1 * | 8/2017 | Sun | F28D 15/04 |
| 2017/0312871 | A1 * | 11/2017 | Lin | B23P 15/26 |
| 2017/0343296 | A1 * | 11/2017 | Lan | F28D 15/0233 |
| 2025/0146762 | A1 * | 5/2025 | Xiong | F28D 15/0275 |

FOREIGN PATENT DOCUMENTS

| | | | | |
|---|---|---|---|---|
| CN | 106643246 A * | 5/2017 | | F28D 15/046 |
| WO | WO-2018030478 A1 * | 2/2018 | | F28D 15/04 |

* cited by examiner

*Primary Examiner* — Tho V Duong
(74) *Attorney, Agent, or Firm* — HDLS IPR SERVICES; Chun-Ming Shih

(57) ABSTRACT

A heat dissipation device includes a vapor chamber (1) and at least one heat pipe (2). The vapor chamber (1) includes a bottom plate (10) and a top plate (11) combined with each other to form a cavity (100); the cavity (100) contains a top plate capillary layer (11*a*) covering the top plate (11) which has at least one through hole (110). The heat pipe (2) includes a pipe body (20) with a closed end (200) and an open end (201) fixed in the through hole (110), and a pipe capillary layer (21) with a connecting portion (210). The top plate (11) includes at least one protrusion (111) corresponding to the through hole (110) and having a receiving portion (111*a*) recessed inside the top plate (11), and a capillary structure (11*b*) in the receiving portion (111*a*) and contacting with the connecting portion (210) and top plate capillary layer (11*a*).

10 Claims, 8 Drawing Sheets

HEAT DISSIPATION DEVICE OF HEAT PIPE COMBINED WITH VAPOR CHAMBER

TECHNICAL FIELD

The present disclosure relates to a heat dissipation device, and more particularly relates to a heat dissipation device of a heat pipe combined with a vapor chamber.

RELATED ART

In general, the related art heat dissipation devices composed of a heat pipe and a vapor chamber involve inserting an open end of the heat pipe into the vapor chamber, allowing the capillary structures inside the heat pipe to make contact with the capillary structures inside the vapor chamber to provide a continuous capillary action. At the same time, the open end of the heat pipe is abutted against a bottom plate inside the vapor chamber to improve the bonding between the heat pipe and the vapor chamber. On one hand, it allows the capillary structures inside the heat pipe to make contact with the capillary structures inside the vapor chamber; on the other hand, it improves the bonding between the heat pipe and the vapor chamber as described above.

However, the insertion of the open end of the heat pipe into the vapor chamber and the contact with the bottom plate of the vapor chamber will hinder the transfer of heat within the vapor chamber, especially it is essential to add an opening on the part where the heat pipe is inserted into the vapor chamber, which effectively reduces the internal communication area between the heat pipe and vapor chamber. Therefore, there will still be some resistance to heat transfer, despite maintaining the continuity of internal capillaries.

In view of this problem, the present discloser has focused on the above drawbacks of the related art to conduct extensive research and experiment and overcome the above-mentioned problem.

SUMMARY OF THE DISCLOSURE

The primary objective of the present disclosure is to provide a heat dissipation device of a heat pipe combined with a vapor chamber that adds a capillary structure to a top plate of the vapor chamber. As a result, the heat pipe may directly make contact with the capillary structure of the top plate of the vapor chamber to maintain the continuity of its internal capillaries, while providing the bonding strength between the heat pipe and the vapor chamber.

To achieve the aforementioned objective, the present disclosure provides a heat dissipation device composed of a vapor chamber and at least one heat pipe. The vapor chamber includes a bottom plate and a top plate, and the bottom plate and the top plate covering and combined with each other to define a cavity, a top plate capillary layer disposed in the cavity and covering the top plate, and the top plate including at least one through hole defined on the top plate. The heat pipe includes a pipe body, and a pipe capillary layer disposed in the pipe body. The pipe body has a closed end and an open end away from the closed end, the open end is fixed in the through hole, and the pipe capillary layer has a connecting portion exposed from the open end. The top plate includes at least one protrusion disposed protrusively from the through hole, the protrusion has a receiving portion recessed from inside of in the top plate, and a capillary structure is disposed in the receiving portion and in contact with the connecting portion and the top plate capillary layer.

DETAILED DESCRIPTION

The technical characteristics of this disclosure will become apparent with the detailed description of the embodiments accompanied with the illustration of related drawings as follows. It is noteworthy that the embodiments and drawings disclosed herein are to be considered illustrative rather than restrictive.

Figure 1:
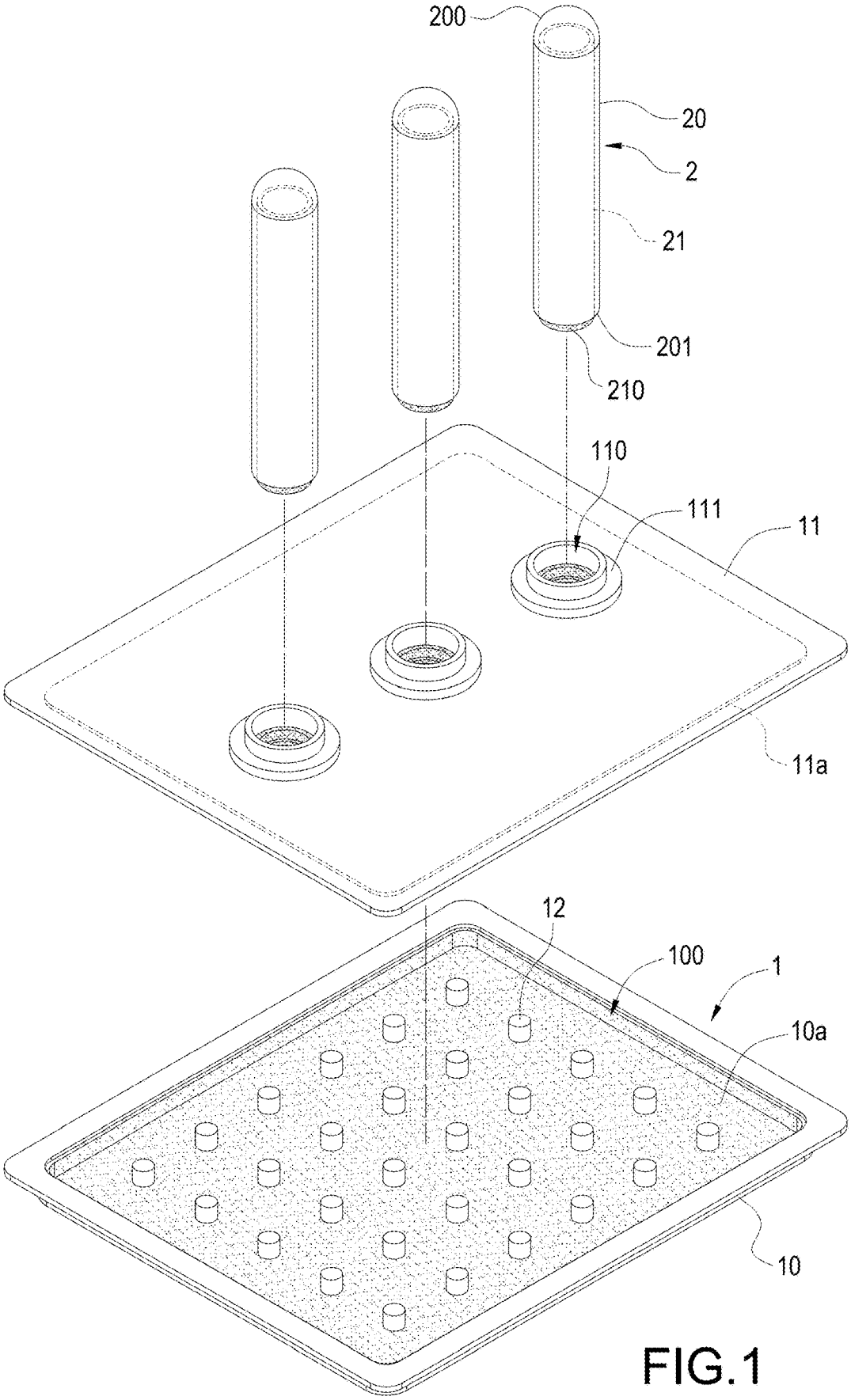
FIG. 1 is a disassembled drawing of a first embodiment of this disclosure.
Figure 2:
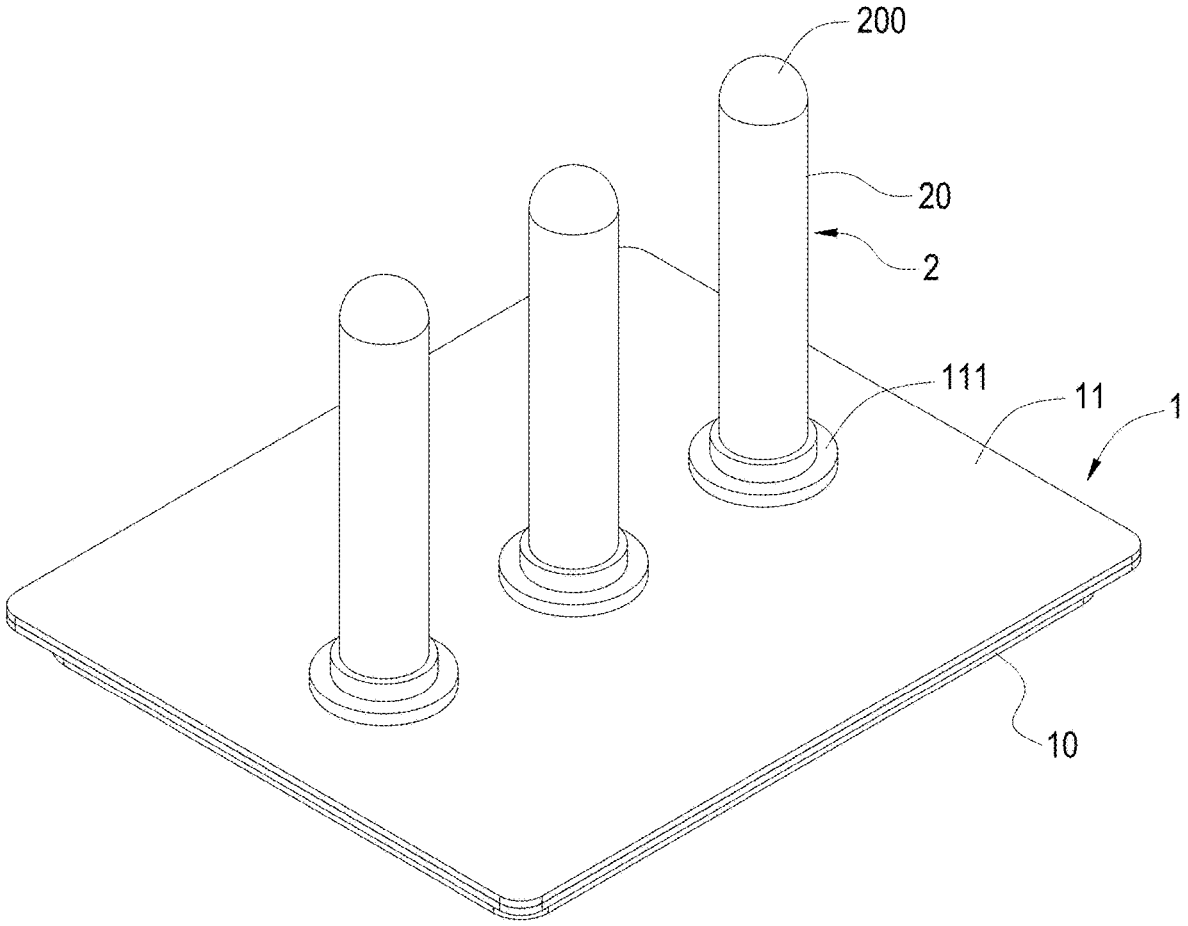
FIG. 2 is an assembled drawing of the first embodiment of this disclosure.

With reference to FIGS. 1 and 2 for the disassembled and assembled drawings of the first embodiment of the present disclosure respectively, the present disclosure provides a heat dissipation device which includes a vapor chamber 1, and at least one heat pipe 2.

Figure 3:
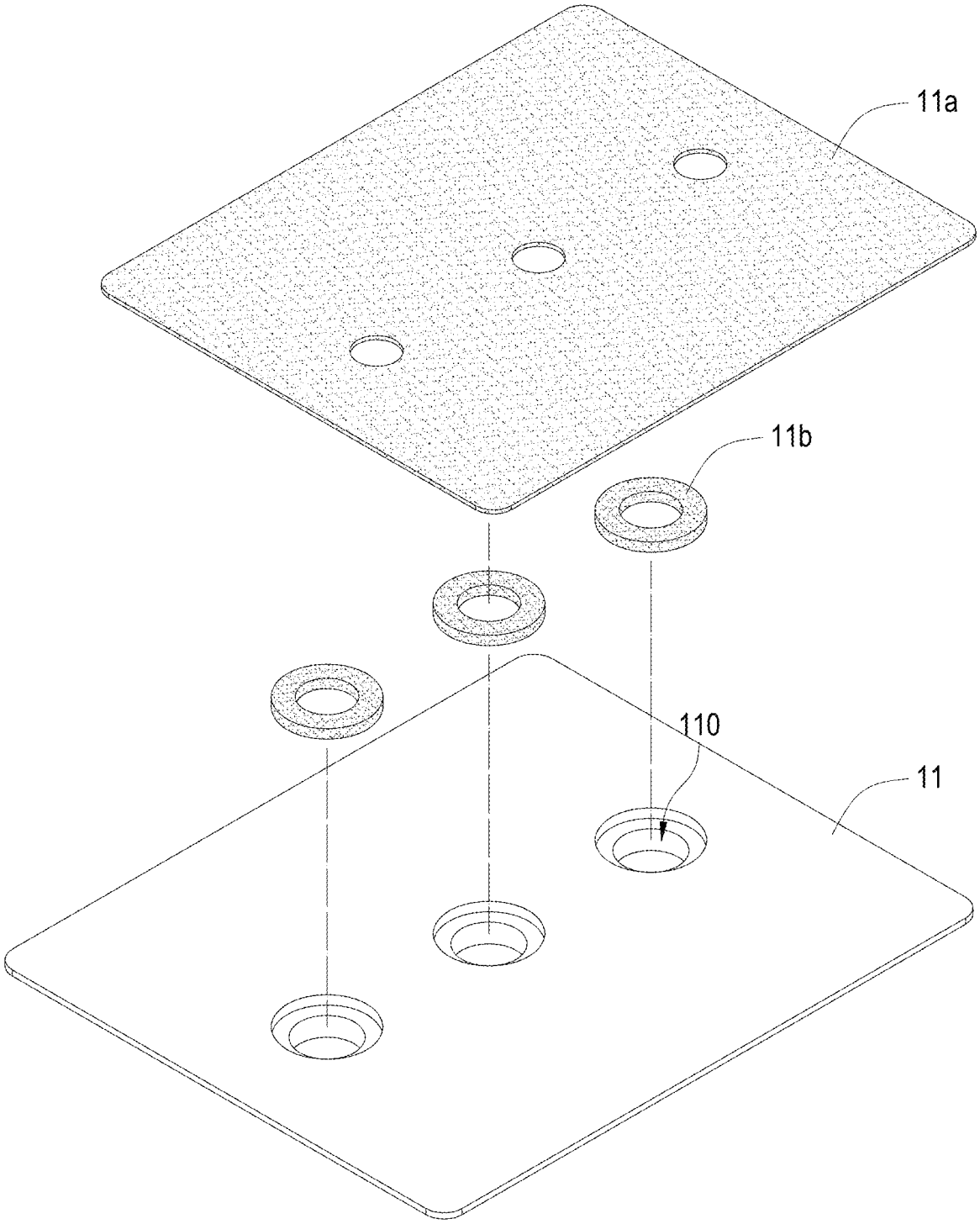
FIG. 3 is a disassembled drawing of a top plate of the first embodiment of this disclosure.

The vapor chamber 1 includes a bottom plate 10 and a top plate 11 covering and combined with each other to form a cavity 100, and a plurality of support structures 12 installed in the cavity 100. In this embodiment, each support structure 12 is in the form of a columnar body and is distributed in the cavity 100 and abuts against the bottom plate 10 and the top plate 11. In FIG. 3, the cavity 100 includes a plate capillary layer 10*a*, 11*a*, the plate capillary layer 10*a*, 11*a* includes a bottom plate capillary layer 10*a* covering the bottom plate 10, and a top plate capillary layer 11*a* covering the top plate 11. The bottom plate capillary layer 10*a* and the top plate capillary layer 11*a* are connected at the junction where the bottom plate 10 and the top plate 11 cover each other. In addition, both the bottom plate capillary layer 10*a* and the top plate capillary layer 11*a* are made of woven mesh.

Figure 4:
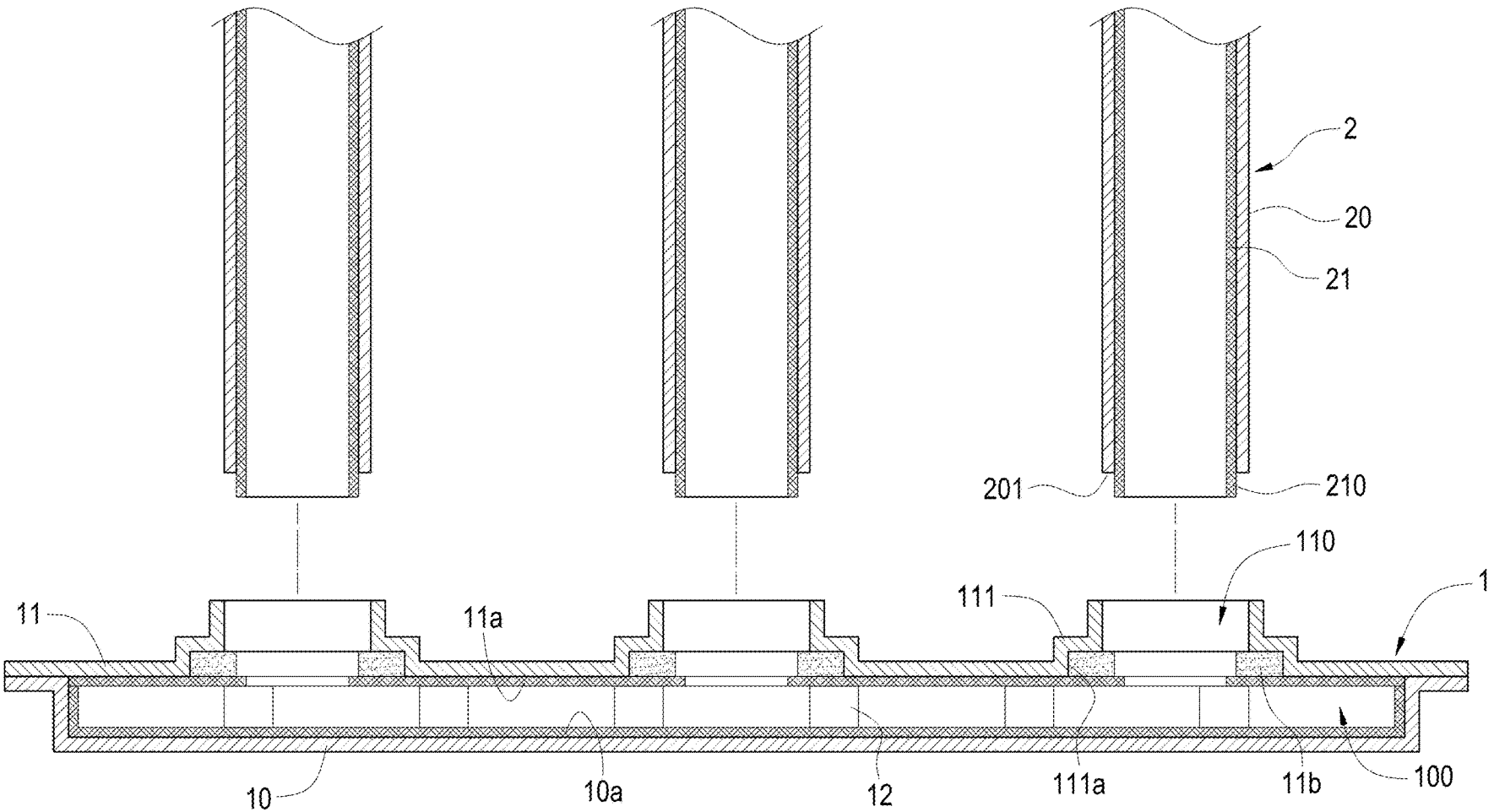
FIG. 4 is a partially cross-sectional view of the first embodiment of this disclosure.
Figure 5:
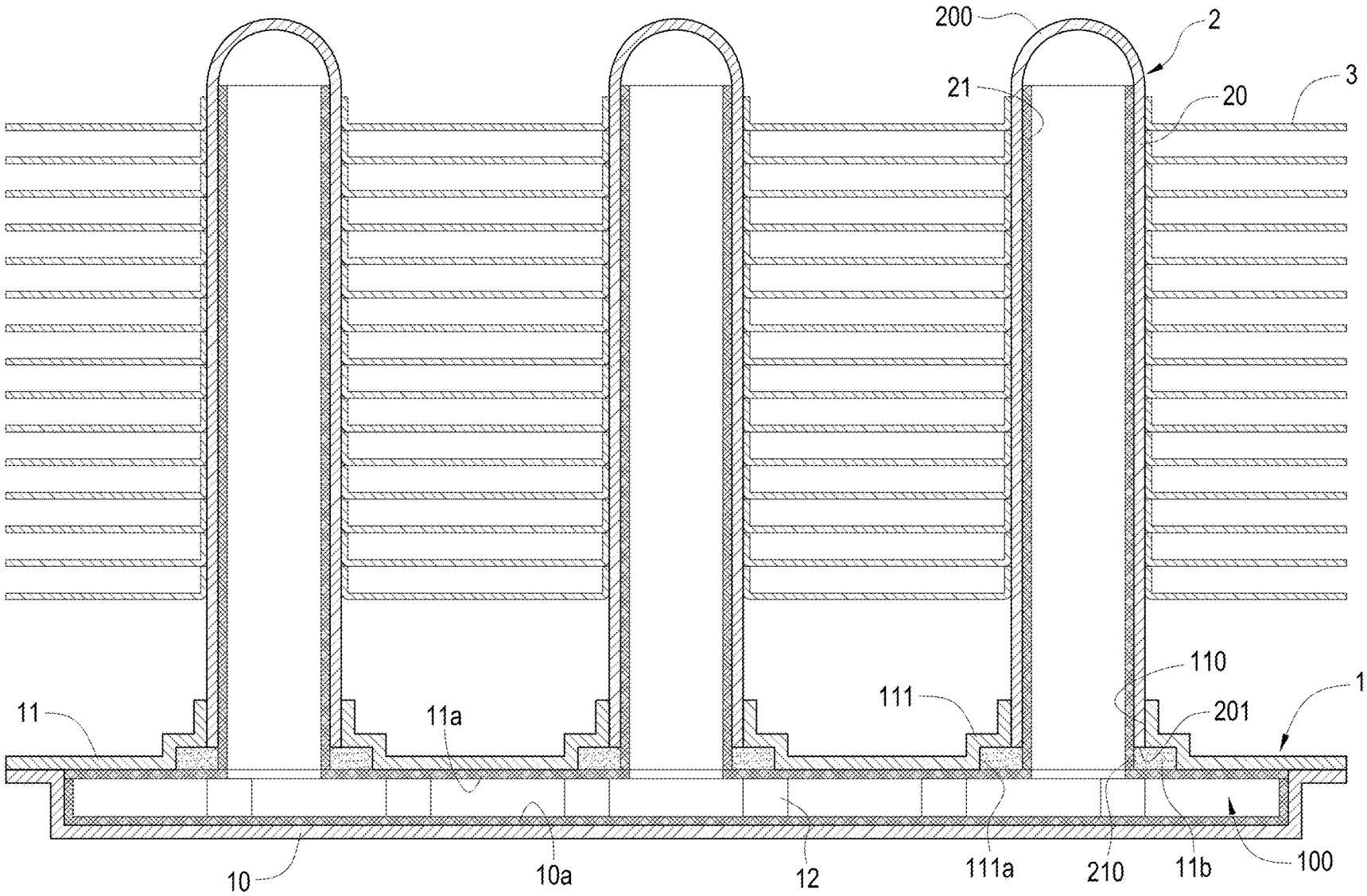
FIG. 5 is a cross-sectional view of the first embodiment of this disclosure combined with a plurality of fins.

In FIGS. 4 and 5, the heat pipe 2 includes a pipe body 20, and a pipe capillary layer 21 disposed on an inner wall of the pipe body 20. The pipe body 20 has a closed end 200, and an open end 201 away from the closed end 200, the pipe capillary layer 21 is attached to the interior of the pipe body 20 and extends from the closed end 200 to the open end 201, and the pipe capillary layer 21 has a connecting portion 210 protruding from the open end 201. In addition, the pipe capillary layer 21 is made of woven mesh.

In FIGS. 1, 2 and 4, the top plate 11 of the vapor chamber 1 is provided with at least one through hole 110 for fixing the open end 201 of the pipe body 20 of the heat pipe 2, and communicating with the cavity 100 of the vapor chamber 1 as shown in FIG. 5. In FIGS. 1 to 5, the present disclosure mainly includes a protrusion 111 formed on the top plate 11 of the vapor chamber 1 and protruding outward, and the protrusion 111 is provided with a recessed receiving portion

111*a* formed inside the top plate 11, and the receiving portion 111*a* of each of the protrusions 111 is provided with a capillary structure 11*b* installed in the receiving portion 111*a*. The capillary structure 11*b* is a sintered powder, and the protrusion 111 corresponding to the outside of the through hole 110 communicates to the through hole 110 and is provided for the connecting portion 210 of the pipe capillary layer 21 to be in contact with the capillary structure 11*b* by the open end 201 protruding from the pipe body 20 to the outside, and to cover the top plate capillary layer 11*a* that covers the bottom of the capillary structure 11*b*, so as to maintain a continuous capillary transmission of the pipe capillary layer 21 in the heat pipe 2 and the top plate capillary layer 11*a* in the vapor chamber 1 without interruption.

Therefore, the heat dissipation device of a heat pipe combined with a vapor chamber in accordance with the present disclosure is accomplished through the aforementioned structural composition.

In FIG. 5, the top plate 11 includes the aforementioned receiving portion 111*a* corresponding to each through hole 110 and each receiving portion 111*a* includes the capillary structure 11*b*, so as to allow the capillary structure 11*b* protruding outside the open end 201 to contact the connecting portion 210. Meanwhile, the top plate capillary layer 11*a* of the top plate 11 covers the bottom of the capillary structure 11*b* to allow the pipe capillary layer 21 in the heat pipe 2 to be connected to the top plate capillary layer 11*a* in the vapor chamber 1 in a capillary transmission without interruption, and the pipe body 20 of the heat pipe 2 no longer needs to be in contact with the bottom plate 10 of the vapor chamber 1 to maintain desirable heat transfer between the heat pipe 2 and the vapor chamber 1. Further, the open end 201 of the pipe body 20 of each heat pipe 2 is abutted against the capillary structure 11*b* to improve the bonding strength between the pipe body 20 and the through hole 110 and mount the plurality of fins 3 on the pipe body 20 of each heat pipe 2.

Figure 6:
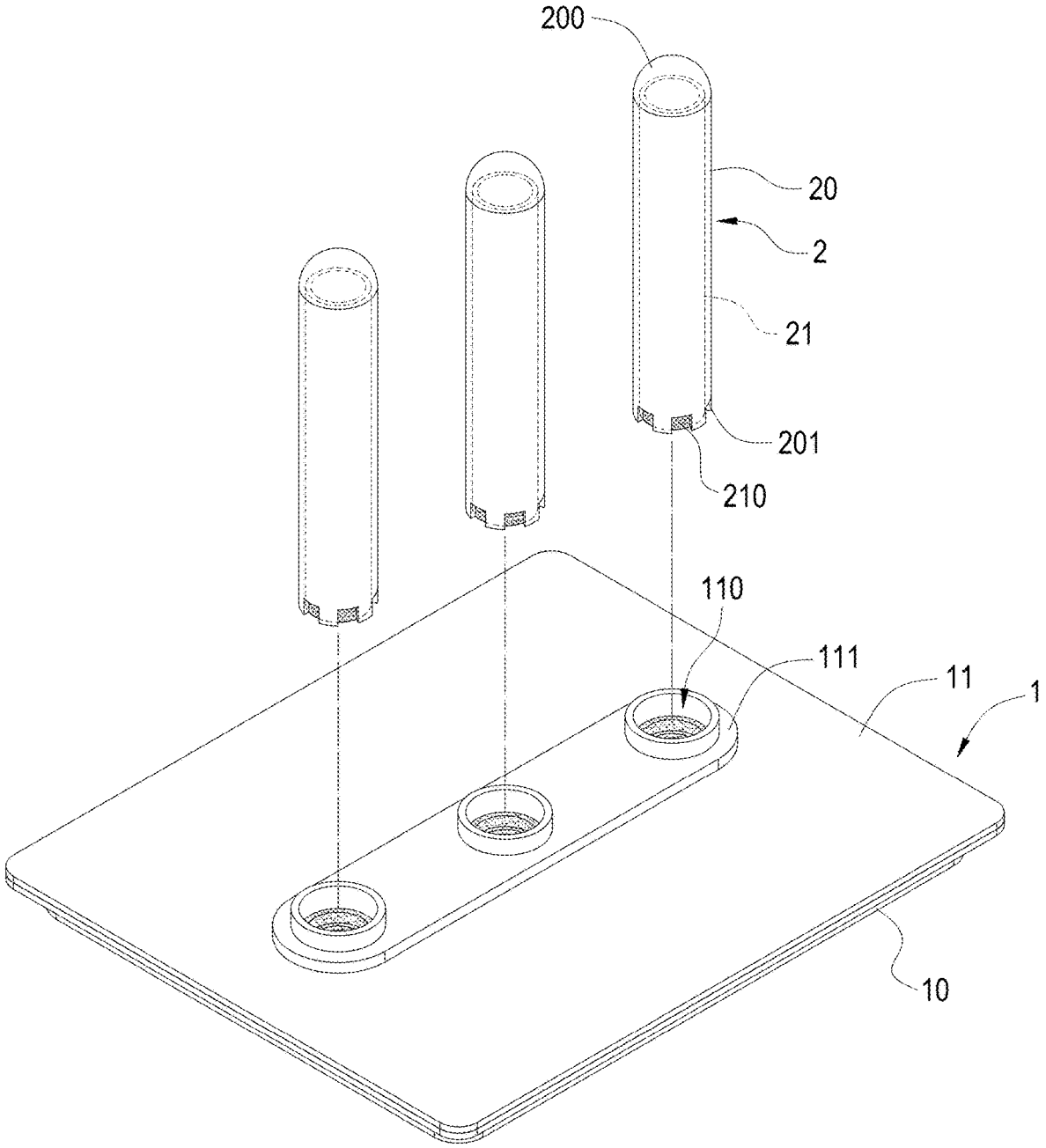
FIG. 6 is a disassembled drawing of a second embodiment of this disclosure.
Figure 7:
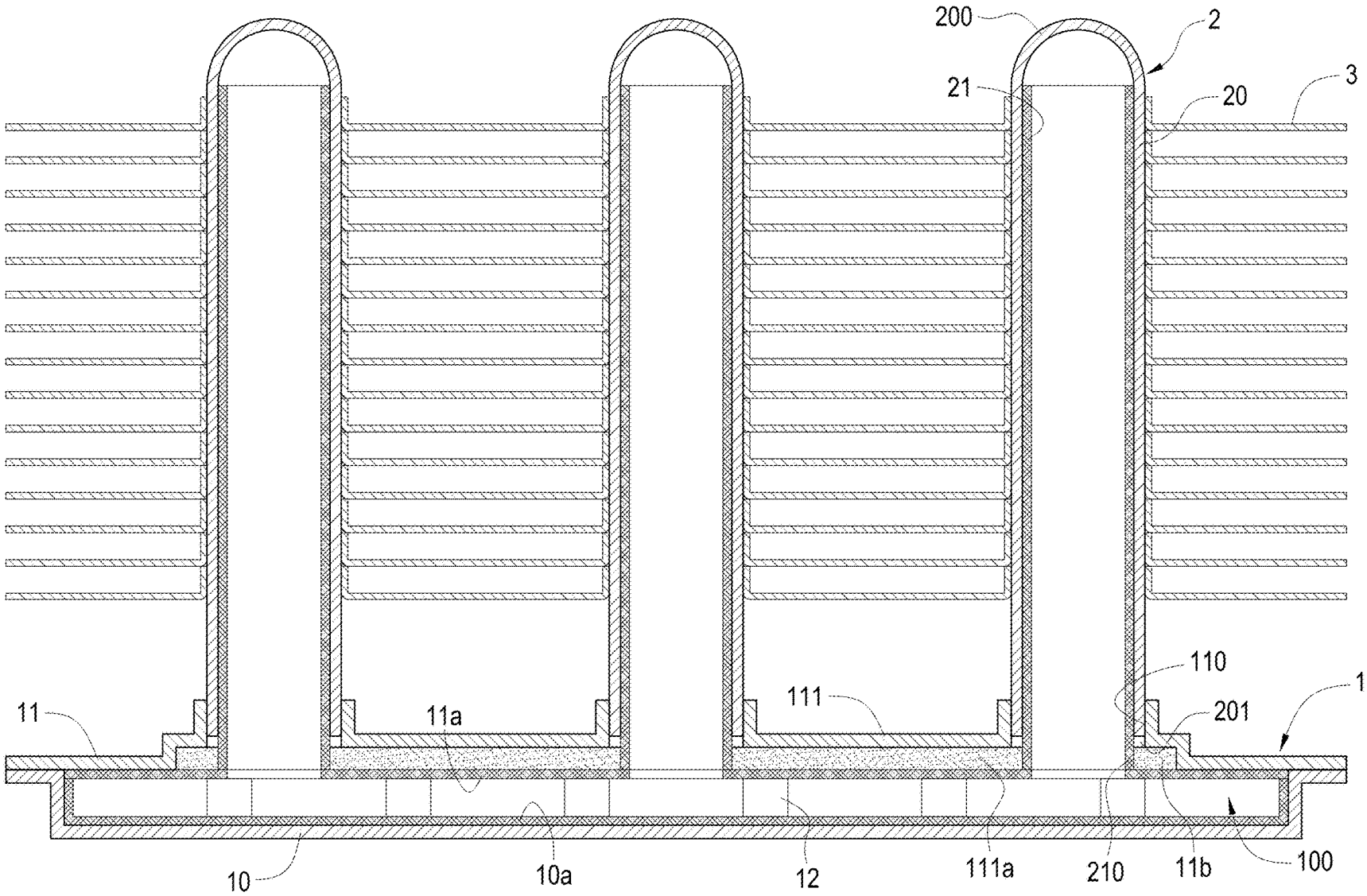
FIG. 7 is a cross-sectional view of the second embodiment of this disclosure combined with a plurality of fins.

In the second embodiment of the present disclosure as shown in FIGS. 6 and 7, when there are protrusions 111 corresponding to the plurality of through holes 110 (in other words, there are multiple of heat pipes 2), the protrusions 111 are integrally connected with one another, so that the receiving portions 111*a* communicate to one another. In addition, the open end 201 of the pipe body 20 of each heat pipe 2 is serrated or partially perforated (not shown in the figure) and provided for the connecting portion 210 of the pipe capillary layer 21 to partially protrude from the serrated open end 201, while the capillary structure 11*b* is in contact with the connecting portion 210 through the serrated recessed portion.

Figure 8:
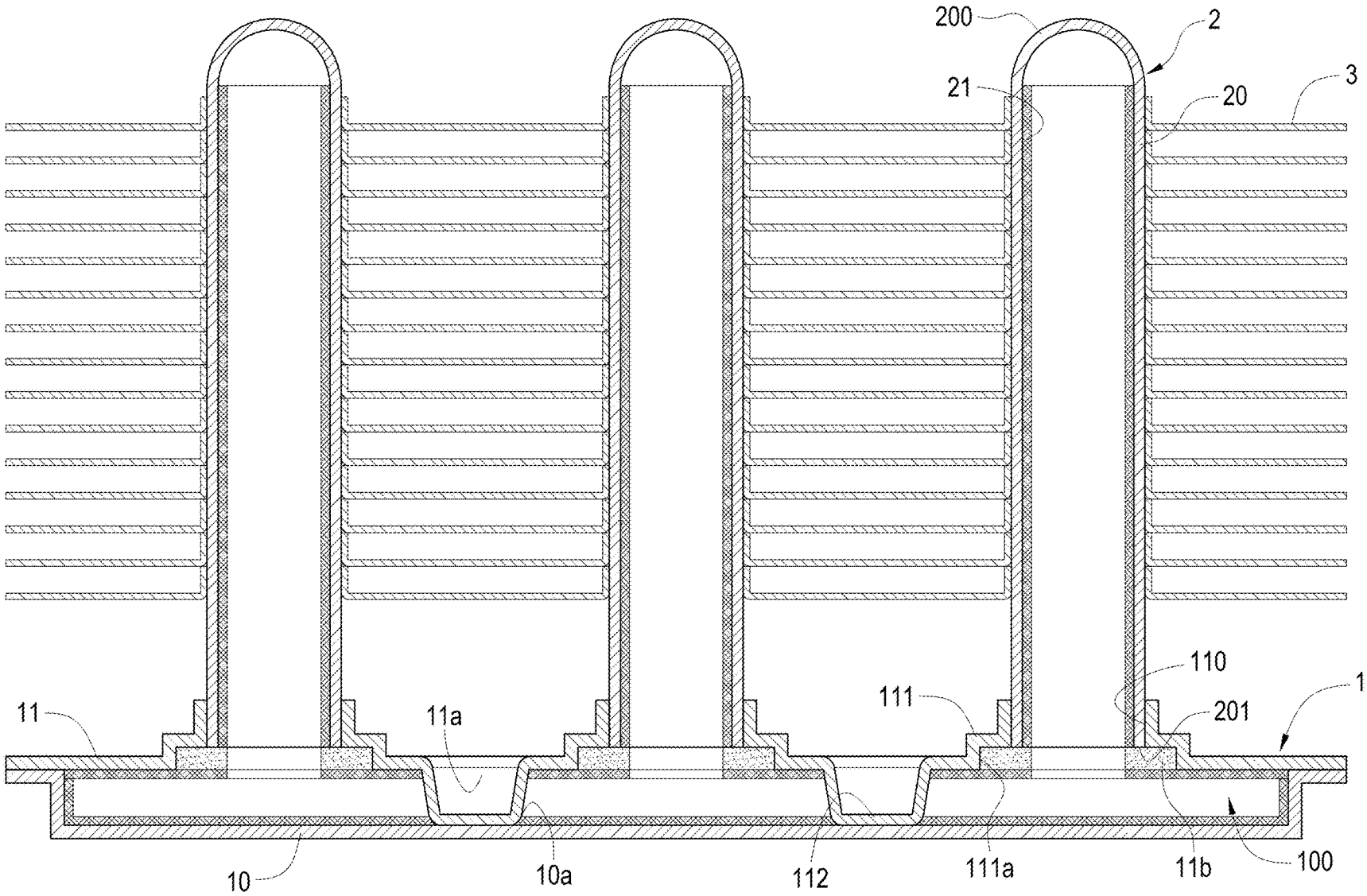
FIG. 8 is a cross-sectional view of a third embodiment of this disclosure combined with a plurality of fins.

In the third embodiment of the present disclosure as shown in FIG. 8, the plurality of abutting parts 112 concavely formed on the top plate 11 and abutted against the bottom plate 10 replaces the aforementioned support structure 12 provided in the cavity 100.

In summation of the description above, the present disclosure surely achieves the purpose of use as stated above, and overcomes the drawbacks of the related art.

While the present disclosure is illustrated by exemplary embodiments, there may be numerous other embodiments of this disclosure, a person skilled in the art may make various corresponding changes and variations in accordance with this disclosure without departing from the spirit of this disclosure, but these corresponding changes and variations shall fall within the scope of protection of the patents applied for in this disclosure.

What is claimed is:

1. A heat dissipation device, comprising:

a vapor chamber (1), comprising a bottom plate (10) and a top plate (11), the bottom plate (10) and the top plate (11) covering and combined with each other to define a cavity (100), a top plate capillary layer (11*a*) disposed in cavity (100) and covering the top plate (11), and the top plate (11) comprising at least one through hole (110) defined thereon; and at least one heat pipe (2), comprising a pipe body (20), and a pipe capillary layer (21) disposed in the pipe body (20), the pipe body (20) comprising a closed end (200) and an open end (201) away from the closed end (200), the open end (201) fixed in the through hole (110), and the pipe capillary layer (21) comprising a connecting portion (210) exposed from the open end (201);

wherein, the top plate (11) comprises at least one protrusion (111) disposed protrusively from the through hole (110), and the protrusion (111) comprises a receiving portion (111*a*) recessed from inside of the top plate (11), and a capillary structure (11*b*) is disposed in the receiving portion (111*a*) and in contact with the connecting portion (210) and the top plate capillary layer (11*a*).

2. The heat dissipation device according to claim 1, wherein the top plate (11) comprises a plurality of abutting parts (112) concavely disposed thereon and abutting against the bottom plate (10).

3. The heat dissipation device according to claim 1, wherein the top plate capillary layer (11*a*) covers a bottom of the capillary structure (11*b*).

4. The heat dissipation device according to claim 1, wherein a bottom plate capillary layer (10*a*) is disposed in the cavity (100) and covering the bottom plate (10), and the bottom plate capillary layer (10*a*) is coupled to the top plate capillary layer (11*a*).

5. The heat dissipation device according to claim 1, wherein the cavity (100) comprises a plurality of support structures (12) disposed therein.

6. The heat dissipation device according to claim 5, wherein the support structures (12) are columnar bodies.

7. The heat dissipation device according to claim 1, wherein an amount of the through hole (110) is multiple, and the protrusion (111) is arranged corresponding to multiple through holes (110) and integrally coupled to the through holes (110), and multiple the receiving portions (111*a*) corresponding to the through holes (110) communicate to each other.

8. The heat dissipation device according to claim 1, wherein the capillary structure (11*b*) is a sintered powder.

9. The heat dissipation device according to claim 1, wherein the open end (201) of the pipe body (20) of the heat pipe (2) abuts against the capillary structure (11*b*).

10. The heat dissipation device according to claim 1, wherein the open end (201) of the pipe body (20) of the heat pipe (2) is serrated or partially perforated.

* * * * *